US006537188B1

(12) United States Patent
Cote et al.

(10) Patent No.: US 6,537,188 B1
(45) Date of Patent: Mar. 25, 2003

(54) VARIABLE-LENGTH CUT-OFF JAW FOLDER

(75) Inventors: Kevin Lauren Cote, Durham, NH (US); David Clarke Pollock, Somersworth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/559,289

(22) Filed: Apr. 27, 2000

(51) Int. Cl.[7] ..... B31B 1/64

(52) U.S. Cl. ..... 493/194; 493/199; 493/258; 493/428; 493/432

(58) Field of Search ..... 493/397, 405, 493/422, 428, 432, 194, 358, 199, 359, 231, 243, 257, 258, 357; 270/8; 83/322–328, 107

(56) References Cited

U.S. PATENT DOCUMENTS 4,893,534 A * 1/1990 Kobler
5,004,451 A * 4/1991 Prum
5,443,437 A * 8/1995 Mack
5,571,069 A * 11/1996 Shah
5,707,330 A * 1/1998 Kiamco et al.
5,865,082 A 2/1999 Cote et al. ..... 83/155
6,159,138 A * 12/2000 Lanvin et al.

OTHER PUBLICATIONS

U.S. Ser. No. 09/452,975, filed Dec. 2, 1999, assigned to Art Unit 3724.

* cited by examiner

*Primary Examiner*—Eugene Kim
(74) *Attorney, Agent, or Firm*—Davidson, Davidson & Kappel, LLC

(57) ABSTRACT

A device for cutting a web of material into signatures and folding the signatures comprising a first set of movable elements and a second set of movable elements, the web moving between the first and second sets of movable elements in a signature formation area. The first set of movable elements includes a first cutting element and a second cutting element variably-spacable with respect to the first cutting element and the second set of movable elements includes a first gripping element for interacting with the first cutting element and a first tucking element variably-spacable with respect to the first gripping element. Also provided is a method for cutting a web into signatures and folding the signatures comprising the steps of spacing a plurality of cutting elements along a first side of the web to set a signature length, spacing a plurality of gripping elements on a second side of the web opposite the plurality of cutting elements, the web traveling between the cutting elements and the gripping elements in a signature formation area, and spacing a plurality of tucking elements on the second side of the web, one of the tucking elements being spaced in between two of the plurality of gripping elements.

16 Claims, 5 Drawing Sheets

VARIABLE-LENGTH CUT-OFF JAW FOLDER

BACKGROUND OF THE INVENTION

1. Field of the Invention

The present invention relates generally to web printing presses and more particularly to a folder for a web printing press as well as to a method for cross-folding printed products.

2. Background Information

Web printing presses print a continuous web of material, such as paper. The continuous web then is cut in a cutting unit so as to form signatures which can then be folded in a folder or arranged in different manners, including providing a cross-fold. However, when variable length cut-off is desired, for example in order to decrease the signature length, it is often necessary to alter the tangential web velocity ratio between the folder and the printing units of the printing press. As a result, the velocity of the signature has to increase after it is cut from the web, which is counter-productive to downstream transport functions. Signatures thus often must be decelerated in a deceleration device. However, conventional fan/bucket deceleration devices often damage the signatures, e.g. through dog-earing, or jam the folder because the transfer from or to the deceleration device fails.

U.S. Pat. No. 5,865,082 discloses an apparatus for forming signatures from a web of material. A pair of rotating cylinders cuts the web to form signatures. A plurality of conveying elements traveling in two loops holds the web as the web passes between the cutting cylinders. The conveying elements thus also hold the signatures as they are formed. This device has the disadvantage that the cutting cylinders merely rotate so that the tangential web velocity ratio of the folder with respect to the printing units must be increased to decrease signature length. Moreover, no fold is provided to the signature.

Commonly-owned U.S. patent application Ser. No. 09/452,975 filed Dec. 2, 1999, which is not prior art to the present application and which is hereby incorporated by reference herein, discloses a variable-length cut-off folder and method. No folding of the printed products is addressed.

BRIEF SUMMARY OF THE INVENTION

An object of the present invention is to provide a reliable device and method for cutting a web into signatures, while permitting for variable-length formats, and to provide a cross-fold to the resultant printed products.

The present invention provides a device for cutting a web of material into signatures and folding the signatures. The device includes a first set of movable elements and a second set of movable elements, the web moving between the first and second sets of movable elements. The first set of movable elements includes a first cutting element and a second cutting element variably-spacable with respect to the first cutting element, and the second set of movable elements includes a first gripping element for interacting with the first cutting element and a first tucking element variably-spacable with respect to the first gripping element.

The present device permits a web to run at a similar speed through the folders and the printing units, while still permitting variable length cut-offs and folding of the printed products.

In one embodiment of the present device, the first set of movable elements includes a first jaw element for interacting with the first tucking element. The jaw element, which preferably is spaced to provide a cross-fold in the middle of the signature, can then deliver the folded signature to a conveyor belt.

In a second embodiment of the present device, a rotating jaw cylinder is located adjacent the second set of movable elements after the signature formation area, the first tucking element interacting with jaws of the jaw cylinder.

The first set of movable elements preferably run in a first closed loop, the first closed loop having a signature formation area. The second set also preferably move in a second closed loop and interact with the first set of movable elements in the signature formation area.

The cutting elements may include either an anvil or blade. If the cutting element includes a blade, the interacting gripping elements include an anvil for the blade. If the cutting elements include an anvil, the gripping elements include a blade. The gripping elements also include a gripper for holding the signature in place.

The movable elements may be driven along a track at variable spacing using controlled disks or variable motor technology as disclosed in U.S. patent application Ser. No. 09/452,975 incorporated by reference above. The blade and anvil and gripping devices may also be similar to those disclosed in the '975 application.

The present invention also provides a method for cutting a web into signatures and folding the signatures comprising the steps of:

- spacing a plurality of cutting elements along a first side of the web to set a signature length;
- spacing a plurality of gripping elements on a second side of the web opposite the plurality of cutting elements, the web traveling between the cutting elements and the gripping elements in a signature formation area; and
- spacing a plurality of tucking elements on the second side of the web, one of the tucking elements being spaced in between two of the plurality of gripping elements.

Preferably, the plurality of tucking elements and the plurality of gripping elements are alternately spaced.

The method may include spacing at least one jaw element on the first side of the web opposite the plurality of tucking elements in the signature formation area. Alternately, the method may include gripping a signature at a cross-fold with a jaw cylinder located opposite the plurality of tucking elements.

BRIEF DESCRIPTION OF THE DRAWINGS

Two embodiments of the present invention are described below by reference to the following drawings, in which.

DETAILED DESCRIPTION

Figure 1:
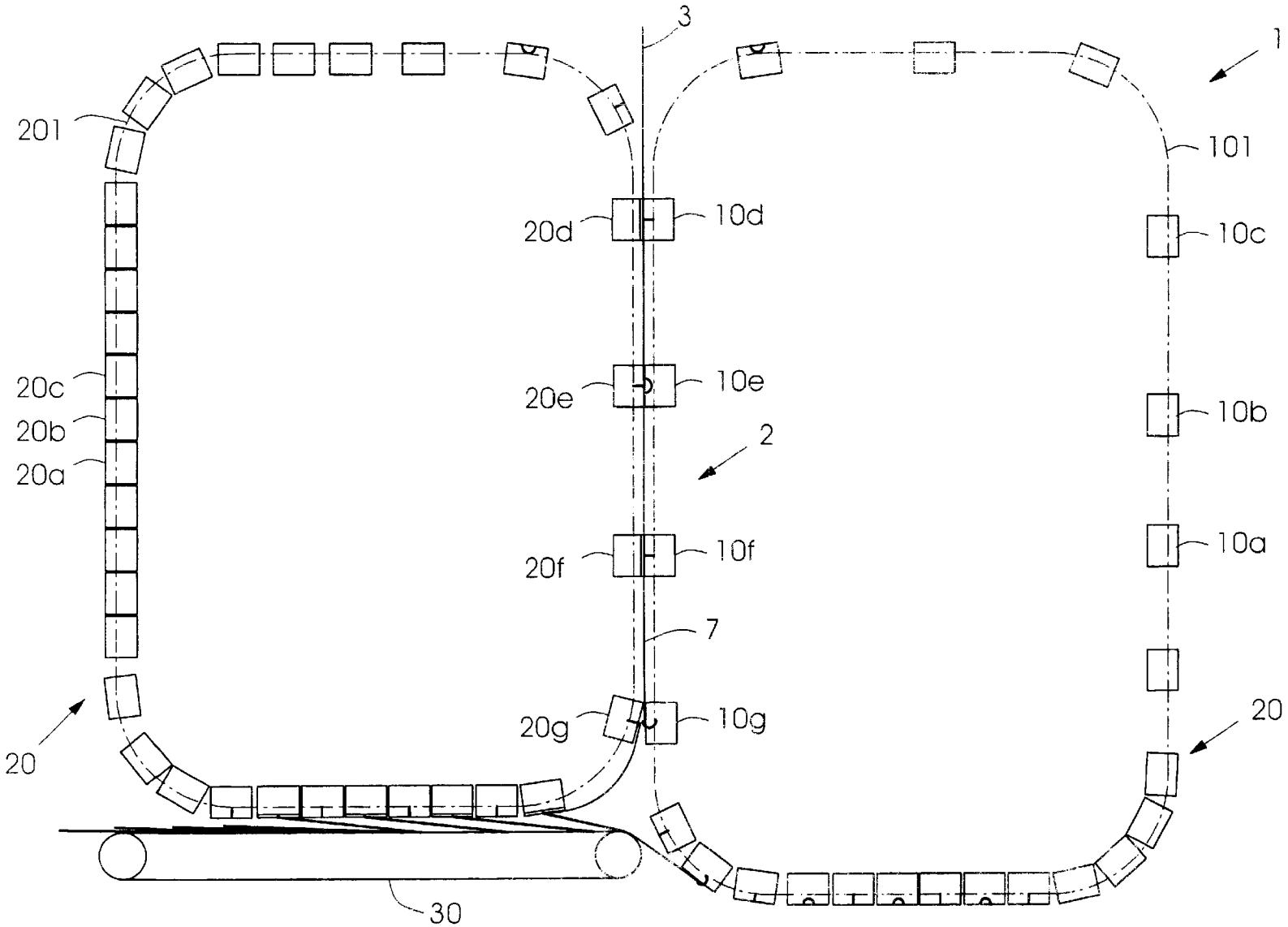
FIG. 1 shows a schematized side view of a folder according to a first embodiment of the present invention.

FIG. 1 shows a folder 1 having a set 10 of movable elements, including movable elements 10*a*, 10*b*, 10*c*, and a set 20 of movable elements, including movable elements 20*a*, 20*b*, 20*c*. Set 10 moves along a track 101 in a counterclockwise direction, while set 20 moves along a track 201 in a clockwise direction, so that sets 10, 20 run next to each other in a signature formation area 2.

Set 10 also includes tucking elements 10*d* and 10*f*, and gripping elements 10*e* and 10*g*. Set 20 includes jaw elements 20*d* and 20*f*, and cutting elements 20*e* and 20*g*. The jaw elements 20*d* and 20*f* interact with tucking elements 10*d* and *f* as will be described. The cutting elements 20*e*, 20*g* interact with gripping elements 10*e*, 10*g*, respectively, in a manner similar to that described in co-pending U.S. patent application Ser. No. 09/452,975 incorporated by reference above. It is noted however, that other cutting and gripping mechanisms are possible, so long as the web is cut and the lead edge gripped by the cutting element/gripping element pair. As defined herein, a cutting element may include either a cutting anvil, in which case a gripper element includes a blade, or, preferably, a cutting blade.

Set 10 has alternating tucking and gripping elements and set 20 has alternating jaw and cutting elements.

A web 3 of material such as paper enters a gap formed between set 10 and set 20 in the signature formation area 2. "Web" as defined herein may include one or more ribbons of material, which may or may not already be longitudinally folded. Web 3 is cut into signatures in signature folding area 2, the signatures being cross-folded and delivered to a conveyor 30.

As web 3 enters the signature formation area, web 3 is held between cutting element 20*e*, which may include bars and a knife, and cutting element 10*e*, which may include a gripper and an anvil. Web 3 is thus gripped between the bars of cutting element 20*e* and the anvil of gripping element 10*e* as the cutting element 20*e* and gripping element 10*e* come together in signature formation area 2. The cutting elements and gripping elements can move at the same velocity as web 3 in the signature formation area 2.

Figure 2:
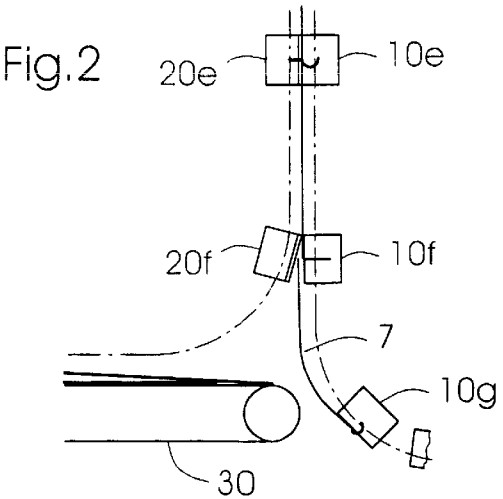
FIG. 2 shows a first printed product being tucked into a jaw element of the folder according to FIG. 1.

As web 3 moves through signature formation area 2, web 3 is gripped between the bars and the anvil, and the knife of cutting element 20*e* cuts web 3, so as to form a lead edge of one signature and a trail edge of another signature 7, as shown in FIG. 2. A front edge of signature 7, already having been cut by cutting element 20*g*, is gripped by the gripper of gripping element 10*g*.

Figure 11:
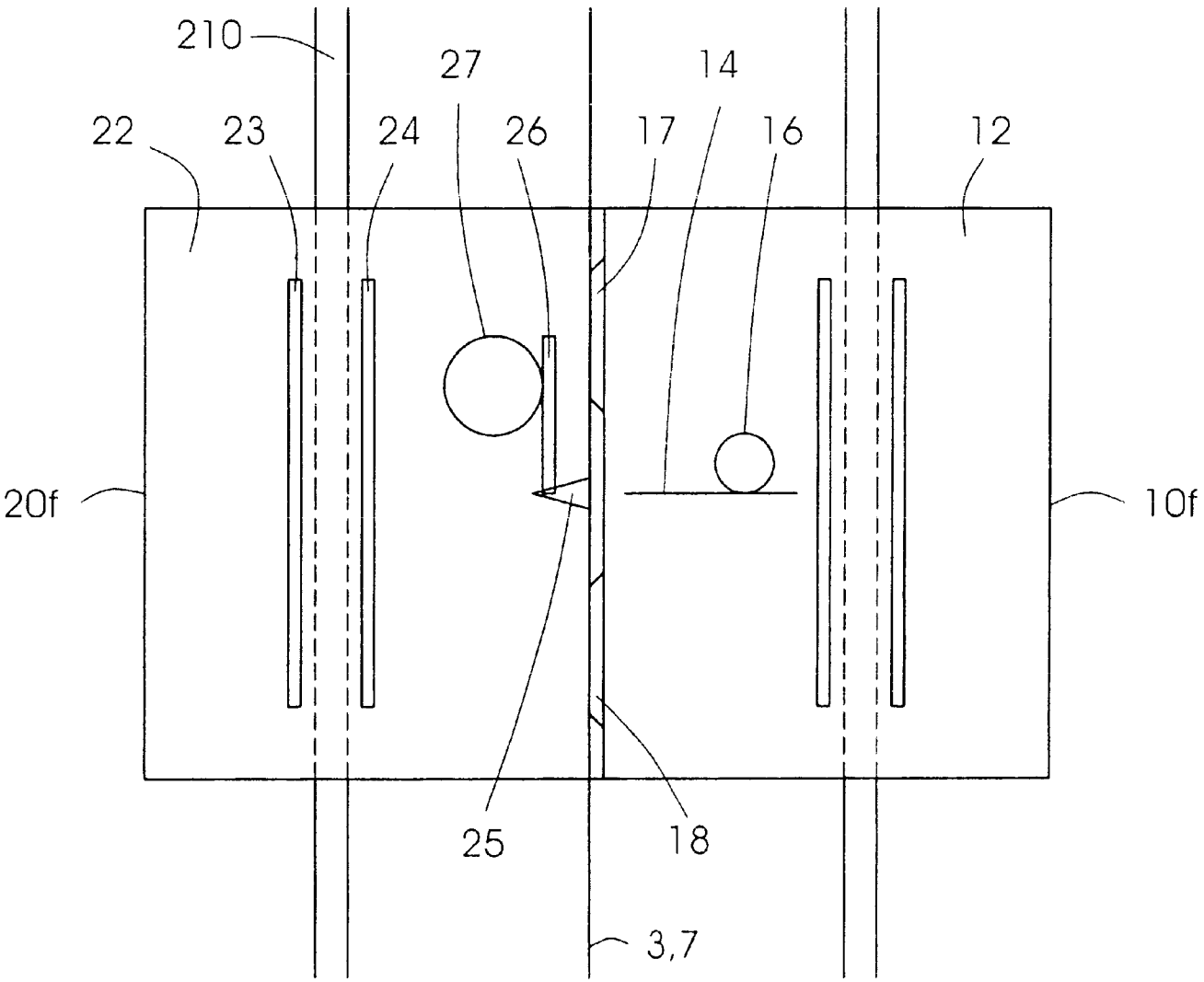
FIG. 11 shows a tucking element and a jaw element of the first embodiment.

Once the trail edge of signature 7 is formed, a tucking blade 14 (FIG. 11) of tucking element 10*f* is activated to fold signature 7 in half by tucking the signature at its midpoint into jaw element 20*f*. A schematic depiction of tucking element 10*f* and jaw element 20*f* is shown in FIG. 11. Each jaw element may comprise a body 22, wheels running on track 201, and magnets 23 and 24 for interacting with windings in the track 201. Magnets 23, 24 may be structured to accommodate any turns or curves in track 201. Jaw element 20*f* may thus be driven using linear motor technology as described in co-pending U.S. patent application Ser. No. 09/452,975 incorporated by reference above. Jaw element 20*f* thus may be variably spaced with respect to cutting elements 20*e* and 20*g*, for example to be midway between these two elements. Alternately, the disk drive described in the '975 application could be used to position the tucking element within signature formation area 2. All of the movable elements of the set 10 and set 20, including jaw element 10*f* can be driven with one of these two technologies to provide variable spacing of the movable elements.

Jaw element 20*f* also includes a jaw 25 and may include a clamp 26 driven by a clamp actuator 27.

Tucking element 10*f* includes a body 12, a tucking blade 14 and a tucking blade actuator 16. Tucking element 10*f* may also include glide elements 17, 18 which loosely position web 3, which becomes a signature 7, between body 12 and body 22. During a tucking operation, signature 7 can move with respect to glide elements 17, 18. Tucking blade 14 may be actuated by tucking blade actuator 16, which can be a gear. The actuator can be actuated by a variable cam mechanism or a motor, for example. The actuating motor could be activated by RF or other wireless signals, for example.

Once the signature 7 is formed, tucking blade 14 is activated to cross-fold signature 7 and tuck the fold in jaw 25 of jaw element 20*f*, as shown in FIG. 2. At this time, clamp 26 may be activated by clamping actuator 27, which may be controlled in a similar manner as blade actuator 16, i.e. cam or motor driven.

Figure 4:
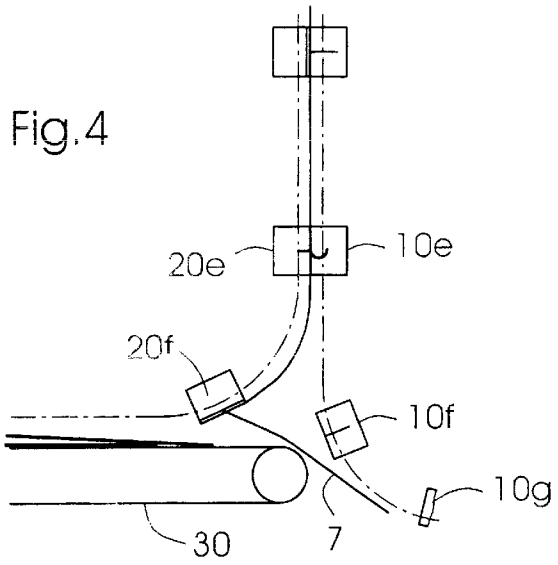
FIGS. 3 and 4 show the first printed product being carried toward a conveyor belt of the folder of FIG. 1.
Figure 3:
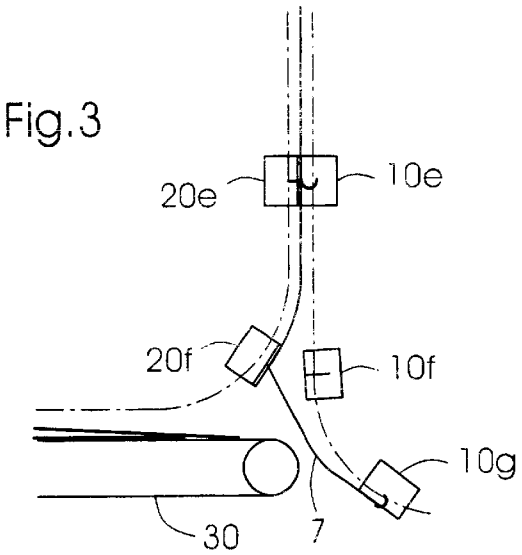
Figure 5:
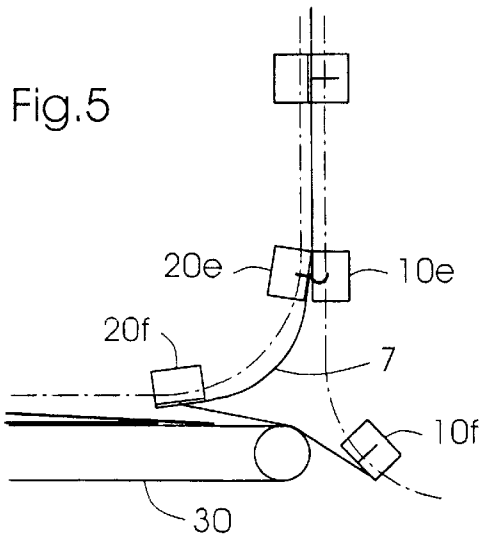

During the folding operation, lead edge of signature 7 is gripped by gripping element 10*g*, and the trail edge is held between a bar of cutting element 20*e* and an anvil of gripping element 10*e*. Gripping element 10*g* decelerates as the fold is created to permit the fold to develop, shown in FIG. 3. As shown in FIGS. 4 and 5, jaw element 20*f* then transports signature 7 to a conveyor belt 30, with the lead edge of signature 7 being released by gripper element 10*g* (FIG. 4) and the trail edge of signature 7 being released from between a bar of cutting element 20*e* and the anvil of gripper element 10*e* (which has since gripped the lead edge of web 3).

Figure 7:
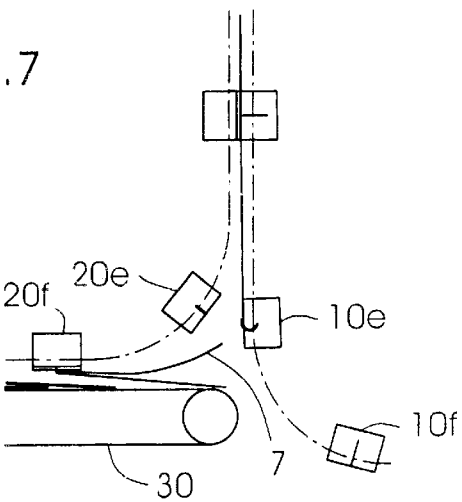
FIGS. 5, 6 and 7 show the first printed product being fully cut and transported to the conveyor belt of the folder of FIG. 1.
Figure 6:
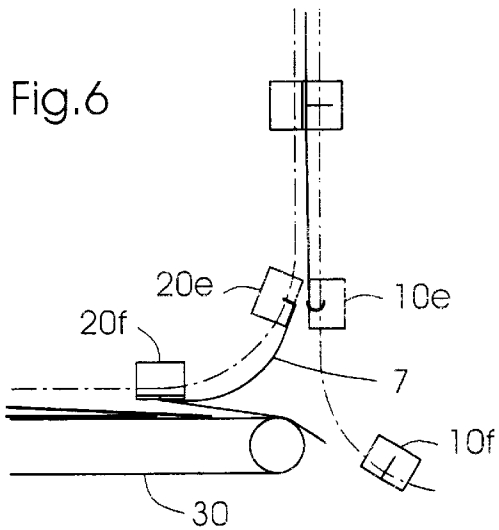

FIGS. 6 and 7 show signature 7 being decelerated and delivered to conveyor belt 30, at which time clamp 26 may be released and the signature further conveyed by conveyor 30.

Figure 8:
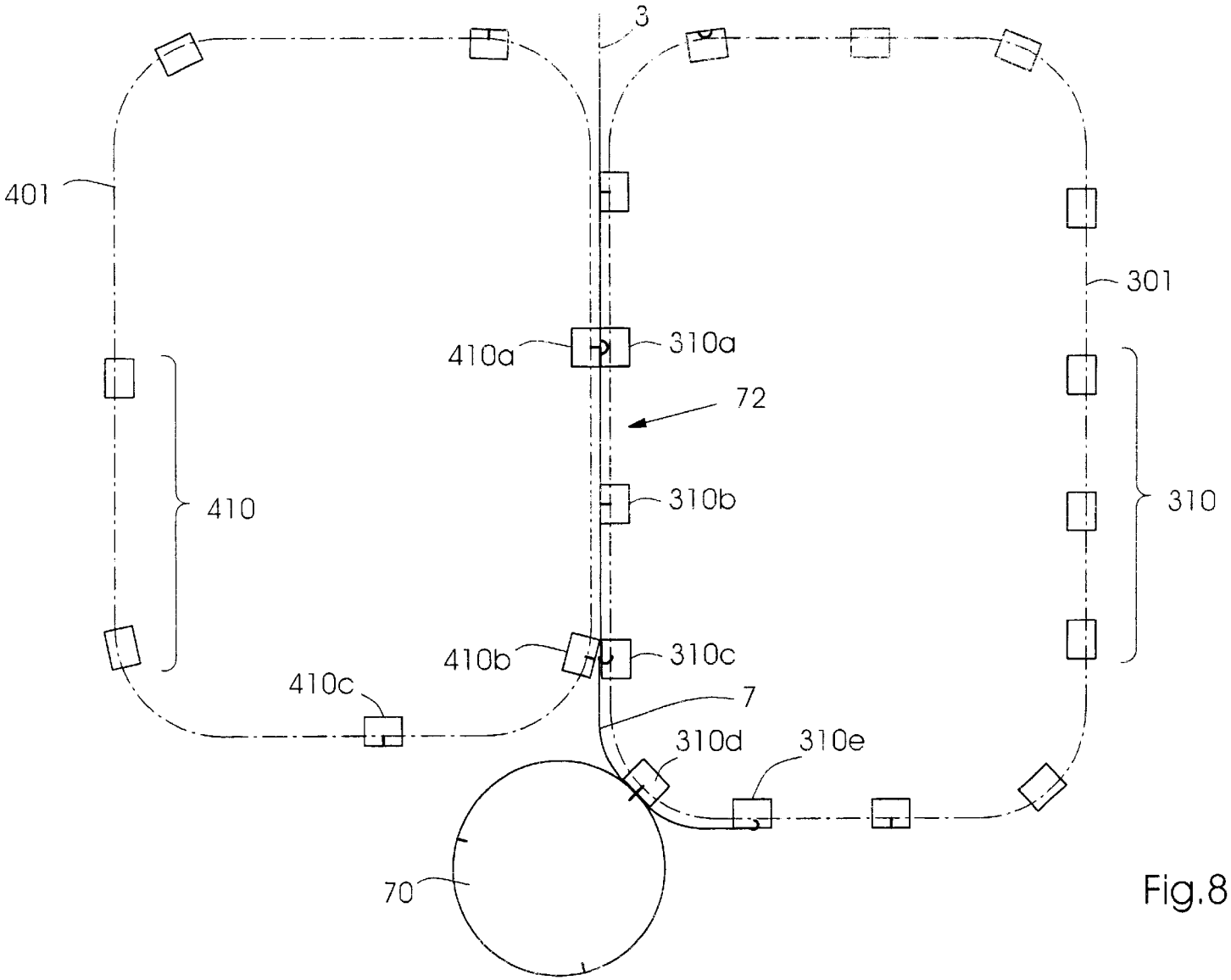
FIG. 8 shows a folder according to a second embodiment of the present invention having a jaw cylinder after a signature formation area.

FIG. 8 shows a second embodiment of the present invention, in which folder has two tracks 301, 401 and a jaw cylinder 70. A set 310 of variably spacable movable elements runs around track 301. Set 310 includes gripping elements 310*a*, 310*c* and 310*e*, as well as tucking elements 310*b*, 310*d*. A set 410 of variably spacable cutting elements runs on track 401, including cutting elements 410*a* and 410*b*.

Figure 10:
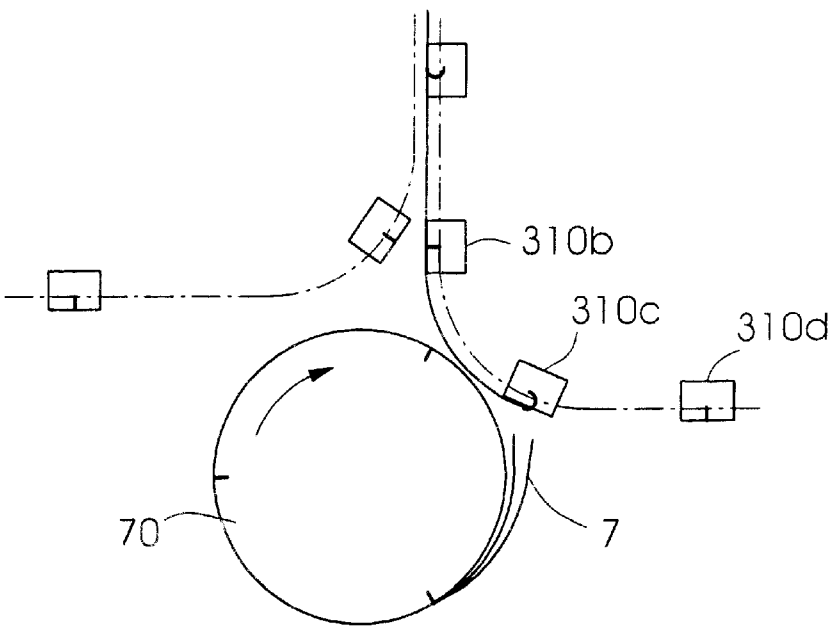
FIGS. 9 and 10 show a signature being tucked in the jaw cylinder of the folder of FIG. 8.
Figure 9:
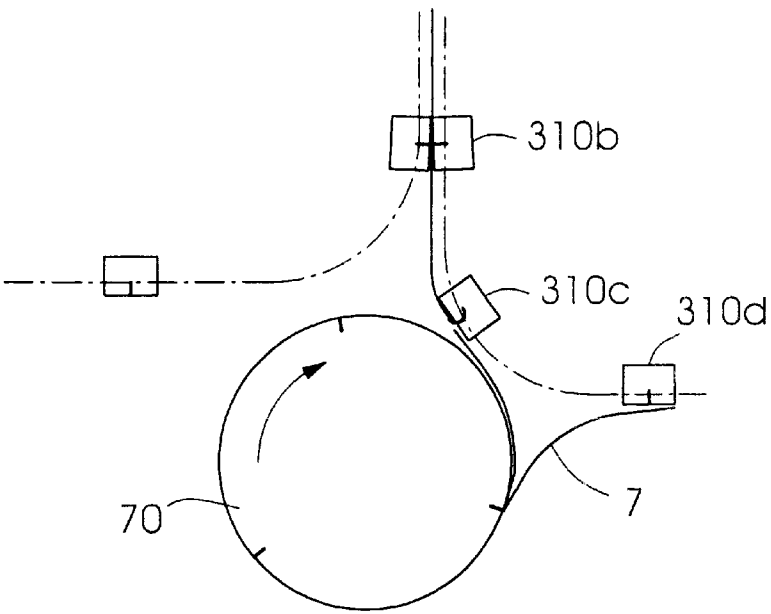

As web 3 enters a signature formation area 72, web 3 is held between cutting elements 410*b* and gripping element 310*c*, and is cut so as to form a trail edge of signature 7 and a lead edge of the next signature gripped by gripping element 310*c*. The lead edge of signature 7 is held by gripping element 310*e* (and was formed by a cut from cutting element 410*c*). As a midpoint of signature 7 reaches jaw cylinder 70, tucking element 310*d* is activated to fold signature 7, which is then further transported by jaw cylinder 70 in a clockwise direction, as shown in FIGS. 9 and 10.

Since the cutting elements and gripping elements may be moved into the signature formation area in a controlled manner, the length of the signatures may be controlled by controlling the distance between consecutive pairs of cutting elements and gripping elements within the signature formation area. Thus the present invention provides for a variable signature length.

As mentioned, linear motor technology may be used to drive the various movable elements. The tracks form the stator of the linear motor. These tracks have electrical windings. The spacing of the windings or the current within the windings can vary to provide for acceleration and deceleration of the movable elements. Thus design of the windings in the stator and controlling the frequency of the current applied to the windings defines and controls the motion and the spacing of the movable elements, which have magnets which are driven by the current in the electrical windings.

Press speed signal and operator inputs of desired cut-to-cut length are linked to the linear motor's controller, for example through a PLC. Depending on the type of linear motor used precise position control of the clamping bars may also require using linear encoder feedback.

"Gripping element" as defined herein need not include a gripper, but may merely function as an anvil or a blade for the respective cutting element.

"Variably spacable" as defined herein means that the movable elements may be moved in a controlled manner to set the distance between the elements.

What is claimed is:

1. A device for cutting a web of material into signatures and folding the signatures comprising:

a first set of movable elements and a second set of movable elements, the web moving between the first and second sets of movable elements in a signature formation area;

the first set of movable elements including a first cutting element and a second cutting element variably-spacable with respect to the first cutting element; and the second set of movable elements including a first gripping element for interacting with the first cutting element and a first tucking element variably-spacable with respect to the first gripping element and a jaw element for interacting with the first tucking element.

2. The device as recited in claim 1 wherein the first set of movable elements includes the jaw element for interacting with the first tucking element.

3. The device as recited in claim 1 wherein the first tucking element includes a tucking blade for providing a cross-fold.

4. The device as recited in claim 2 further comprising a conveyor belt for accepting cross-folded signatures from the jaw element.

5. The device as recited in claim 2 wherein the jaw element includes a jaw for accepting a cross-fold in a signature.

6. The device as recited in claim 2 wherein the second set has alternating tucking and gripping elements.

7. The device as recited in claim 2 wherein the first set has alternating cutting and jaw elements.

8. The device as recited in claim 1 further comprising a jaw cylinder with the jaw element adjacent the second set of movable elements after the signature formation area.

9. The device as recited in claim 8 wherein the first set of movable elements includes only cutting elements.

10. The device as recited in claim 8 wherein the second set of movable elements has alternating gripping and tucking elements.

11. The device as recited in claim 1 wherein the first set of movable elements run in a first closed loop and the second set moves in a second closed loop.

12. A method for cutting a web into signatures and folding the signatures comprising the steps of:

spacing a plurality of cutting elements along a first side of the web to set a signature length;

spacing a plurality of gripping elements on a second side of the web opposite the plurality of cutting elements, the web traveling between the cutting elements and the gripping elements in a signature formation area; and spacing a plurality of tucking elements on the second side of the web, one of the tucking elements that interacts with a jaw element and is spaced in between two of the plurality of gripping elements.

13. The method as recited in claim 12 wherein the plurality of tucking elements and the plurality of gripping elements are alternately spaced.

14. The method as recited in claim 12 further comprising spacing the jaw element on the first side of the web opposite the plurality of tucking elements in the signature formation area.

15. The method as recited in claim 14 further comprising gripping a signature at a cross-fold with the jaw element.

16. The method as recited in claim 12 further comprising gripping a signature at a cross-fold with a jaw cylinder having the jaw element located opposite the plurality of tucking elements.

* * * * *

UNITED STATES PATENT AND TRADEMARK OFFICE

CERTIFICATE OF CORRECTION

PATENT NO. : 6,537,188 B1
DATED : March 25, 2003
INVENTOR(S) : Cote et al.

It is certified that error appears in the above-identified patent and that said Letters Patent is hereby corrected as shown below:

Column 5,
Lines 18-31, should be deleted and replaced with the following:

1. A device for cutting a web of material into signatures and folding the signatures comprising:

a first set of movable elements and a second set of movable elements, the web moving between the first and second sets of movable elements in a signature formation area;

the first set of movable elements a first cutting element and a second element variably-spacable with respect to the first cutting element;

the second set set of movable elements including a first gripping element for interacting with the first cutting element and a first tucking element variably-spacable with respect to the first gripping element; and a jaw element for interacting with the first tucking element.

UNITED STATES PATENT AND TRADEMARK OFFICE

CERTIFICATE OF CORRECTION

PATENT NO. : 6,537,188 B1
DATED : March 25, 2003
INVENTOR(S) : Cote et al.

It is certified that error appears in the above-identified patent and that said Letters Patent is hereby corrected as shown below:

Column 6,
Lines 17-29, claim 12 should read:

12. A method for cutting a web into signatures and folding the signatures comprising the steps of:

spacing a plurality of cutting elements along a first side of the web to set a signature length;

spacing a plurality of gripping elements on a second side of the web opposite the plurality of cutting elements, the web traveling between the cutting elements and the gripping elements in a signature formation area; and spacing a plurality of tucking elements on the second side of the web, one of the tucking elements that interacts with a jaw element being spaced in between two of the plurality of gripping elements.

Signed and Sealed this

Ninth Day of September, 2003

JAMES E. ROGAN
*Director of the United States Patent and Trademark Office*